US010062324B2

(12) United States Patent
Kim et al.

(10) Patent No.: US 10,062,324 B2
(45) Date of Patent: Aug. 28, 2018

(54) LUMINANCE CONTROL DEVICE AND DISPLAY DEVICE COMPRISING THE SAME

(71) Applicant: LG DISPLAY CO., LTD., Seoul (KR)

(72) Inventors: Hyojin Kim, Paju-si (KR); Suhyuk Jang, Paju-si (KR); Hyejin Kim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 32 days.

(21) Appl. No.: 15/299,982

(22) Filed: Oct. 21, 2016

(65) Prior Publication Data

US 2017/0124959 A1 May 4, 2017

(30) Foreign Application Priority Data

Oct. 29, 2015 (KR) ..... 10-2015-0151424

(51) Int. Cl.
*G09G 3/3291* (2016.01)
*G09G 3/3225* (2016.01)

(52) U.S. Cl.
CPC ... *G09G 3/3225* (2013.01); *G09G 2300/0452* (2013.01); *G09G 2320/041* (2013.01); *G09G 2320/045* (2013.01); *G09G 2320/0626* (2013.01); *G09G 2360/16* (2013.01)

(58) Field of Classification Search
CPC ..... G09G 3/3225; G09G 2300/0452; G09G 2320/041; G09G 2320/045; G09G 2320/0626; G09G 2360/16; G09G 5/10
USPC ..... 345/101, 102, 690
See application file for complete search history.

(56) References Cited

U.S. PATENT DOCUMENTS 7,133,008 B2 * 11/2006 Naganuma ..... G09G 3/294 345/63
2005/0248517 A1 * 11/2005 Luther Weindorf ..... G09G 3/3208 345/82
2006/0290638 A1 * 12/2006 Kang ..... G09G 3/2011 345/98
2007/0222738 A1 * 9/2007 Yoshida ..... G09G 3/20 345/101
2009/0289965 A1 * 11/2009 Kurokawa ..... G09G 3/3406 345/690

* cited by examiner

*Primary Examiner* — Stacy Khoo
(74) *Attorney, Agent, or Firm* — Dentons US LLP

(57) ABSTRACT

A display device is disclosed in which a luminance control device includes a temperature sensor that detects a temperature of a display device; an average picture level part that calculates an average picture level, which defines an average brightness of an image input into the display device; and a luminance control part that generates a temperature-dependent peak luminance, which varies with temperature and average picture level, based on a top gain curve defining how a maximum luminance decreases as the temperature of the display device rises and a bottom gain curve defining how a minimum luminance decreases as the temperature of the display device rises, wherein the luminance control part fixes the temperature-dependent peak luminance at a specific luminance level, regardless of changes in average picture level, at a specific temperature in a high-temperature range which is higher than a room-temperature range.

6 Claims, 7 Drawing Sheets

| White Area | Before PLC | After PLC | APL | PLC Gain |
|---|---|---|---|---|
| 100% | 600nit | 400nit | 100% | 66.6% |
| 10% | 600nit | 600nit | 10% | 100% |

| White Area | 10% | 20% | 30% | 40% | 50% | 60% | 70% | 80% | 90% | 100% |
|---|---|---|---|---|---|---|---|---|---|---|
| Measurement Pattern | | | | | | | | | | |
| PLC Gain | 255 | 230 | 220 | 215 | 210 | 200 | 196 | 184 | 174 | 170 |

LUMINANCE CONTROL DEVICE AND DISPLAY DEVICE COMPRISING THE SAME

This application claims the priority benefit of Korean Patent Application No. 10-2015-0151424 filed on Oct. 29, 2015, which is hereby incorporated herein by reference for all purposes as if fully set forth herein.

BACKGROUND

Field of the Invention

The present invention relates to a luminance control device, a display device comprising the same and a method of controlling luminance of a display device.

Discussion of the Related Art

The pixels of an organic light-emitting diode ("OLED") display comprise organic light-emitting diodes ("OLEDs"), which are self-emissive. As shown in FIG. 1, an OLED is composed of a stack of organic compound layers including a hole injection layer HIL, a hole transport layer HTL, an emission layer EML, an electron transport layer ETL, and an electron injection layer EIL, with all the layers situated between an anode and a cathode. The OLED display reproduces input images based on a phenomenon in which electrons and holes recombine in the organic layer in the OLED of each pixel to emit light as current flows through a fluorescent or phosphorescent organic thin film.

The OLED display can be classified into many types, depending on types of emissive material, emission methods, emission structures and driving methods. The OLED display can be classified as a fluorescent emission device or a phosphorescent emission device depending on emission methods, or classified as a top emission device or a bottom emission device depending on emission structures. Also, the OLED display can be classified as a PMOLED (Passive Matrix OLED) display or an AMOLED (Active Matrix OLED) display depending on driving methods.

To efficiently reduce power consumption of a display device, it is beneficial to lower screen brightness. Simply turning down brightness can reduce power consumption, however, it may degrade picture quality. If the user turns down the brightness of display images, especially in a high-temperature range, not in a room-temperature range, the brightness of images with a high average picture level (hereinafter, "APL") may become too low. APL is defined as the average brightness of the brightest color in 1-frame image data.

At room temperature, the higher the APL, the more the bright pixel data relative to the total amount of pixel data. By contrast, the lower the APL, the more the bright pixel data relative to the total amount of pixel data. For 8 bits of pixel data, the peak white gray level is "255." On the other hand, in a high-temperature range, where the brightness is much lower than the brightness at room temperature, the peak white gray level is lower than "128."

As depicted in FIG. 2, when about 10% of the pixels across the entire screen displays the peak white gray level and the other pixels display the black gray level 0, the APL is 10%. By contrast, when the pixels across the entire screen display the peak white gray level 255, the APL is 100%. In what follows, the peak luminance is defined as the luminance at 10% APL, and the full white luminance is defined as the luminance at 100% APL.

In peak luminance control (hereinafter, PLC), based on a variation with APL of luminance shown in FIG. 3 and PLC curve shown in FIG. 4, if the APL is low, the peak luminance can be turned up by increasing the PLC gain, and if the APL is high, the peak luminance can be turned down by decreasing the PLC gain.

Based on the PLC curve, when the APL is 10%, the peak luminance is turned up by increasing the PLC gain. The peak luminance gain is 100%. When the APL is 10%, the peak luminance is kept at 600 nits. Based on the PLC curve, when the APL is 100%, the peak luminance is turned down by decreasing the PLC gain. The peak luminance gain is 66.6%. At 100% APL, the peak luminance is adjusted from 600 nits to 400 nits.

As stated above, the brightness of display images is kept within a certain range as the peak luminance varies with increase or decrease in APL at room temperature.

Meanwhile, as shown in FIG. 5, temperature brightness control (hereinafter, "TBC") for controlling brightness by temperature is put into operation, along with PLC control, at a particular temperature higher than room temperature, to control maximum brightness.

Since both PLC control and TBC control are put into operation at a high temperature of 85° C.—a specific temperature higher than room temperature, maximum luminance is adjusted to a lower level than it was originally intended. That is, maximum luminance may be brought down to a level lower than 50% of what could be achieved at the high temperature of 85° C.

SUMMARY

Accordingly, the present invention is directed to a luminance control device, a display device comprising the same and a method of controlling luminance of a display device that substantially obviate one or more problems due to limitations and disadvantages of the related art.

An advantage of the present invention is to provide a display device with improved picture quality.

Additional features and advantages of the present invention will be set forth in the description which follows, and in part will be apparent from the description, or may be learned by practice of the invention. These and other advantages of the present invention will be realized and attained by the structure particularly pointed out in the written description and claims hereof as well as the appended drawings.

To achieve these and other advantages and in accordance with the purpose of embodiments of the invention, as embodied and broadly described herein, a luminance control device may, for example, include a temperature sensor that detects a temperature of a display device; an average picture level part that calculates an average picture level, which defines an average brightness of an image input into the display device; and a luminance control part that generates a temperature-dependent peak luminance, which varies with temperature and average picture level, based on a top gain curve defining how a maximum luminance decreases as the temperature of the display device rises and a bottom gain curve defining how a minimum luminance decreases as the temperature of the display device rises, wherein the luminance control part fixes the temperature-dependent peak luminance at a specific luminance level, regardless of changes in average picture level, at a specific temperature in a high-temperature range which is higher than a room-temperature range.

In another aspect, a display device may, for example, include a data driver that converts an input image's pixel data to an analog gamma voltage to output and supply data voltages to data lines on a display panel; a gate driver that supplies gate pulses synchronized with the data voltages to gate lines on the display panel; and a timing controller comprising a luminance control part that detects an ambient temperature of a display panel, that controls operation timings of the data driver and gate driver, that calculates an average picture level, which defines an average brightness of an image input into the display panel, and that generates a temperature-dependent peak luminance, which varies with temperature and average picture level, based on a top gain curve defining how a maximum luminance decreases as the temperature of the display panel rises and a bottom gain curve defining how a minimum luminance decreases as the temperature of the display panel rises, wherein the luminance control part fixes the temperature-dependent peak luminance at a specific luminance level, regardless of changes in average picture level, at a specific temperature in a high-temperature range which is higher than a room-temperature range.

A steep decline in luminance may be reduced or prevented by fixing the temperature-dependent peak luminance at a specific luminance level, regardless of changes in average picture level, at a specific temperature in a high-temperature range which is higher than a room-temperature range. Consequently, picture quality can be improved.

Moreover, OLED degradation may be reduced by controlling the peak luminance of display images based on the temperature of the ambient environment of the display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Figures 1, 2:
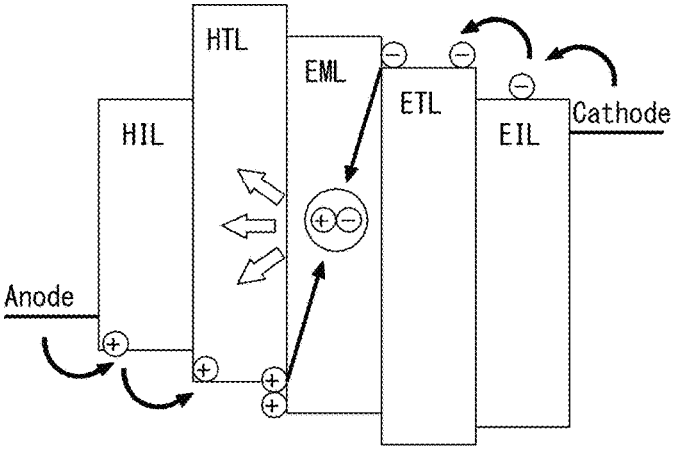
FIG. 1 (RELATED ART)
FIG. 2 (RELATED ART)
FIG. 1 is a view showing an organic light-emitting diode (OLED) structure and electroluminescence principle.
FIG. 2 is view showing pixels that emit light at peak luminance and full white luminance.
Figure 3:
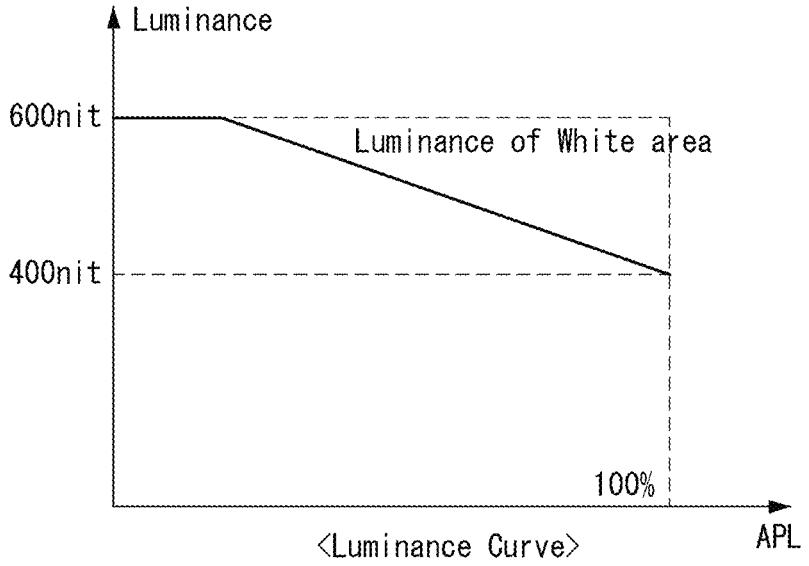
FIG. 3 (RELATED ART)
FIG. 3 is a view showing variation with APL of luminance.
Figure 4:
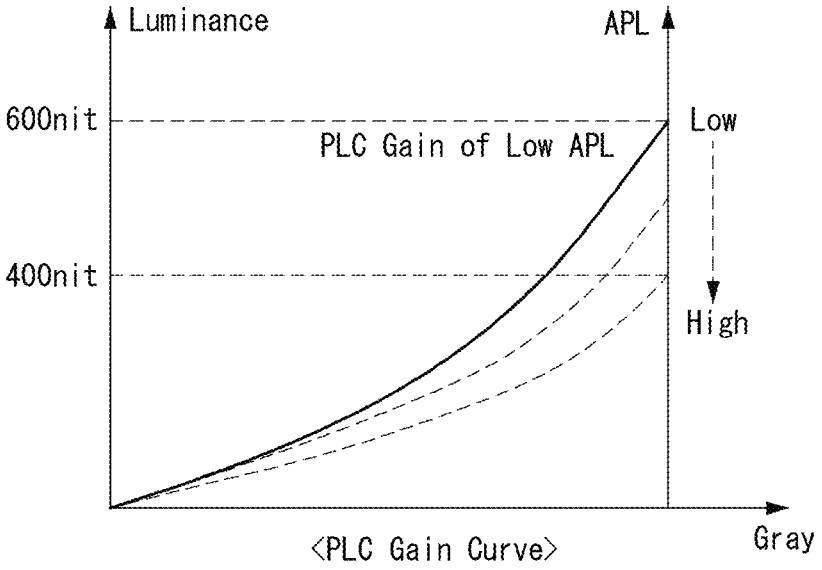
FIG. 4 (RELATED ART)
FIG. 4 is a view showing a PLC curve in PLC control.
Figure 5:
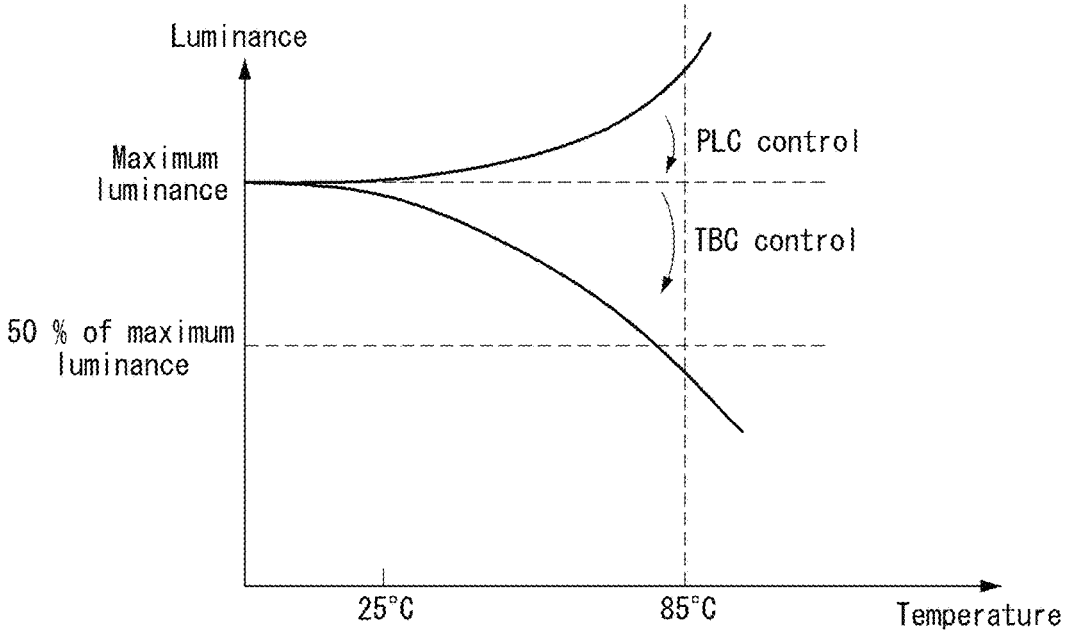
FIG. 5 (RELATED ART)
FIG. 5 is a view showing when both PLC control and TBC control are implemented.

Reference will now be made in detail to embodiments illustrated in the accompanying drawings, examples of which are illustrated in the accompanying drawings.

Hereinafter, exemplary embodiments of the present invention will be described in detail with reference to the accompanying drawings. The same reference numerals will be used throughout the specification to refer to substantially the same elements. When it is deemed that a detailed description of known functions or configurations may unnecessarily obscure the subject matter of the present invention, a detailed description thereof will be omitted.

In an embodiment of the present invention, factors that accelerate OLED degradation can be reduced by adjusting the peak luminance of display images based on the ambient temperature of a display panel. In an embodiment of the present invention, a sudden decrease in brightness can be avoided so that the maximum luminance and the temperature-dependent peak luminance are substantially equal within a preset high-temperature range.

Figure 6:
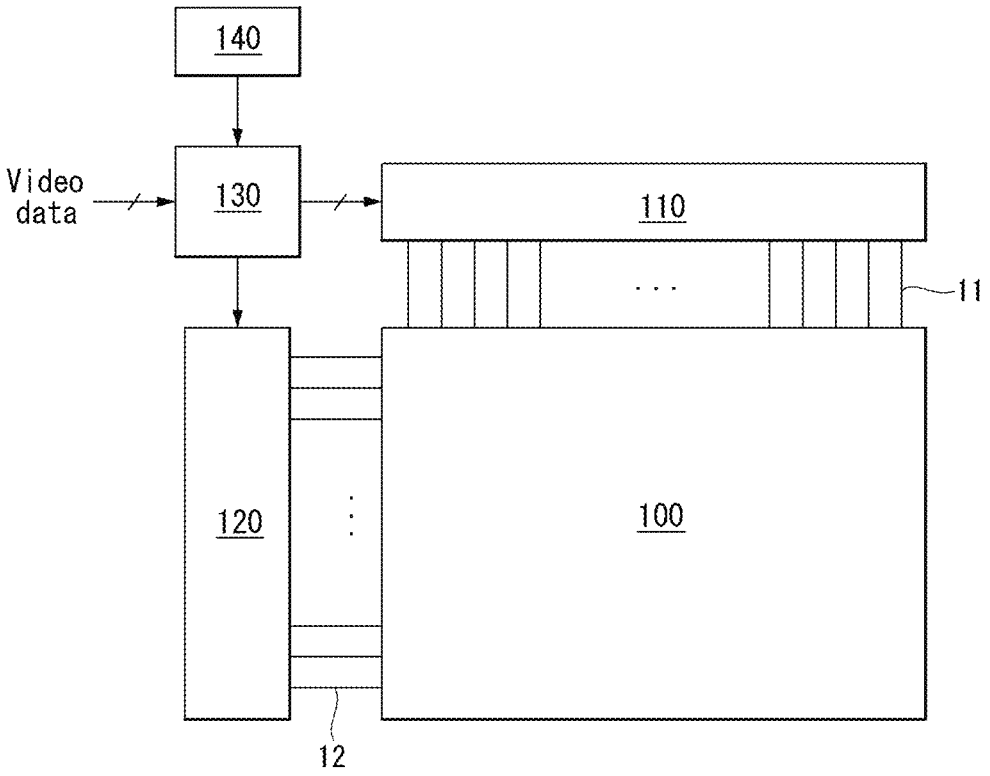
FIG. 6 is a block diagram illustrating a display device according to an exemplary embodiment of the present invention.

FIG. 6 is a block diagram illustrating a display device according to an exemplary embodiment of the present invention.

Referring to FIG. 6, the display device comprises a display panel 100, a data driver 110, a gate driver 120, a timing controller 130, and a temperature sensor 140.

A plurality of data lines 11 and a plurality of scan lines (or gate lines) 12 cross each other in a pixel array of the display panel 100. The pixel array of the display panel 100 comprises pixels P that are arranged in a matrix form and display an input image. Each pixel is segmented into an R subpixel, a G subpixel, a B subpixel, and a W subpixel. Each subpixel comprises an OLED, a switching element, a driving element, a storage capacitor, etc. The switching element and the driving element may be implemented as TFTs (thin-film transistors). The OLED may be composed of a stack of organic compound layers, including a hole injection layer HIL, a hole transport layer HTL, an emission layer EML, an electron transport layer ETL, and an electron injection layer EIL. The switching element applies a data voltage received through the data lines to the gate of the driving element in response to a scan pulse from the scan lines. The driving element adjusts the current flowing through the OLED depending on the gate voltage. The storage capacitor is connected between the gate and source of the driving element. Each pixel may further comprise a sensing circuit for sensing variations in the characteristics of an internal compensation circuit or driving element (not shown). The internal compensation circuit is a circuit for compensating for variations in the threshold voltage and mobility of the driving element.

The data driver 110 converts an input image's pixel data received from the timing controller 130 to an analog gamma voltage to output a data voltage, and supplies the data voltage to the data lines 11 on the display panel 100. The input image's pixel data input into the data driver 110 is the input image's digital video data. The data driver 110 comprises a plurality of source drive ICs, etc.

The gate driver 120 supplies gate pulses (or scan pulses) synchronized with the data voltage of the data driver 110 to the gate lines (or scan lines) 12 under the control of the timing controller 130. The gate driver 120 sequentially shifts the gate pulses to sequentially select pixels, line by line, to which data is written.

The timing controller 130 comprises a luminance control part that controls the operation timings of the data driver 110 and gate driver 120, that calculates an average picture level, which defines the average brightness of an image input into the display panel 100, and that generates a temperature-dependent peak luminance, which varies with temperature and average picture level, based on a top gain curve defining how the maximum luminance decreases as the temperature of the display panel 100 rises and a bottom gain curve defining how the minimum luminance decreases as the temperature of the display panel 100 rises. The timing controller 130 controls the operation timings of the data driver 110 and gate driver 120 based on the timing signals that are input in synchronization with the input image's pixel data. The timing signals comprise a vertical synchronization signal Vsync, a horizontal synchronization signal Hsync, a clock signal CLK, and a data enable signal DE.

The timing controller 130 may receive the input image's pixel data and the timing signals from a host system (not shown). The host system may be implemented as any one of the following: a television system, a set-top box, a navigation system, a DVD player, a Blu-ray player, a personal computer (PC), a home theater system, and a phone system.

The temperature sensor 140 detects the ambient temperature of the display panel 100. The temperature sensor 140 is placed near the display panel 100's module and detects the temperature of the ambient environment of the display device. The temperature sensor 140 converts a detected temperature to a digital signal and outputs it. Here, the digital signal is a signed digital signal comprising a plus code and a minus code. The signed digital signal is a signal produced by digitally converting a detected temperature below or above zero.

Figure 7:
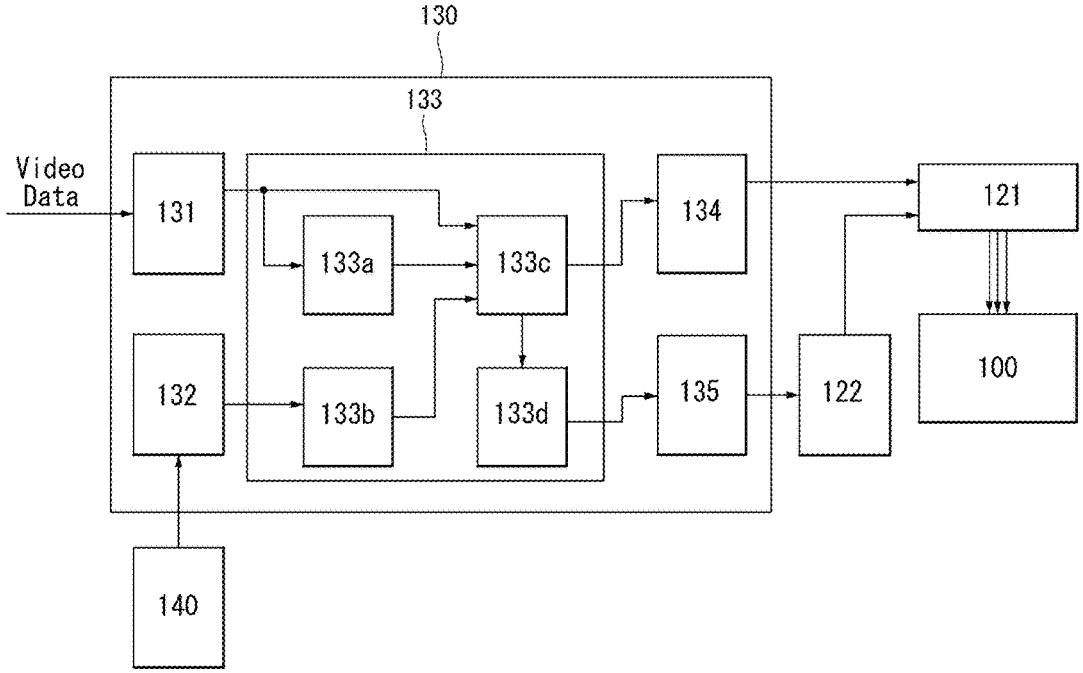
FIG. 7 is a block diagram illustrating a timing controller according to an exemplary embodiment of the present invention.

FIG. 7 is a block diagram showing in detail a timing controller according to an exemplary embodiment of the present invention.

Referring to FIG. 7, the timing controller 130 comprises a data input part 131, a temperature input part 132, an average picture level part 133*a*, a temperature controller 133*b*, a luminance control part 133*c*, a power controller 133*d*, a data output part 134, and a power output part 135.

The data input part 131 may receive an input image's pixel data and timing signals from a host system (not shown). The data input part 131 supplies the received pixel data of the input image to the average picture level part 133*a*.

The average picture level part 133*a* calculates the APL for 1 frame of input image data. The APL is the average brightness of 1-frame image data.

The temperature input part 132 receives a signed digital signal from the temperature sensor 140 via $I^2C$ (inter-integrated circuit) communication. The temperature input part 132 converts an input signed digital signal to an unsigned digital signal and supplies it to the temperature controller 133*b*. The temperature input part 132 receives the signed digital signal and converts in to an unsigned digital signal that can be represented by a number ranging from 0 to 255 (for 8 bits), and supplies it to the temperature controller 133*b*.

The temperature controller 133*b* sets a luminance range based on top and bottom gain curves showing variation with the temperature of the ambient environment of the display device. The temperature controller 133*b* sets a luminance range based on a top gain curve defining how the maximum luminance decreases as the temperature of the display device rises and a bottom gain curve defining how the minimum luminance decreases as the temperature of the display device rises. Here, maximum luminance values and minimum luminance values are preset and stored in a look-up table. Accordingly, the temperature controller 133*b* sets a luminance range by selecting the maximum and minimum luminance values specified for a temperature from the look-up table.

The luminance control part 133*c* generates a temperature-dependent luminance, which varies with temperature and average picture level, based on a top gain curve that defines how the maximum luminance decreases as the temperature of the display panel 100 rises and a bottom gain curve that defines how the minimum luminance decreases as the temperature of the display panel 100 rises. The luminance control part 133*c* adjusts either or both of pixel data and gamma voltage data to be written to the display panel 100 according to the generated temperature-dependent peak luminance. This will be described in detail later.

The data output part 134 may receive from the luminance control part 133*c* the pixel data to be written to the display panel 100 and output it according to a protocol for an interface used on the source drive ICs.

The power controller 133*d* receives gamma voltage data from the luminance control part 133*c* and supplies it to the power output part 135.

The power output part 135 may receive gamma voltage data from the power controller 133*d* and output it according to a protocol for an interface used on a gamma reference voltage generator via $I^2C$ (inter-integrated circuit) communication.

The gamma reference voltage generator 122 may be implemented as a gamma IC that varies an output voltage according to the gamma voltage data supplied from the timing controller 130. The gamma reference voltage generator 122 generates a gamma reference voltage, whose level increases or decreases in proportion to gamma voltage data. For example, the gamma reference voltage generator 122 turns down the gamma reference voltage if the received gamma voltage data has a high value, and turns up the gamma reference voltage if the received gamma voltage data has a low value. The grayscale voltage range of the source drive ICs 121 may vary with the gamma reference voltage.

The gamma reference voltage generator 122 may decrease the value of the gamma voltage data in order to represent low luminance. As such, turning down the luminance by using the gamma voltage data alone may make it difficult to ensure a data margin and also may make it difficult to represent luminance in a certain range. To make up for this, the gamma reference voltage generator 122 can make it easy to ensure a data margin by using the gamma reference voltage as well as the gamma voltage data, in order to represent luminance. The gamma reference voltage 122 may make it easy to adjust the temperature-dependent peak luminance by dividing the temperature-dependent peak luminance into at least one level according to the temperature-dependent peak luminance gain and adjusting the gamma voltage data according to the temperature-dependent peak luminance.

Figure 8:
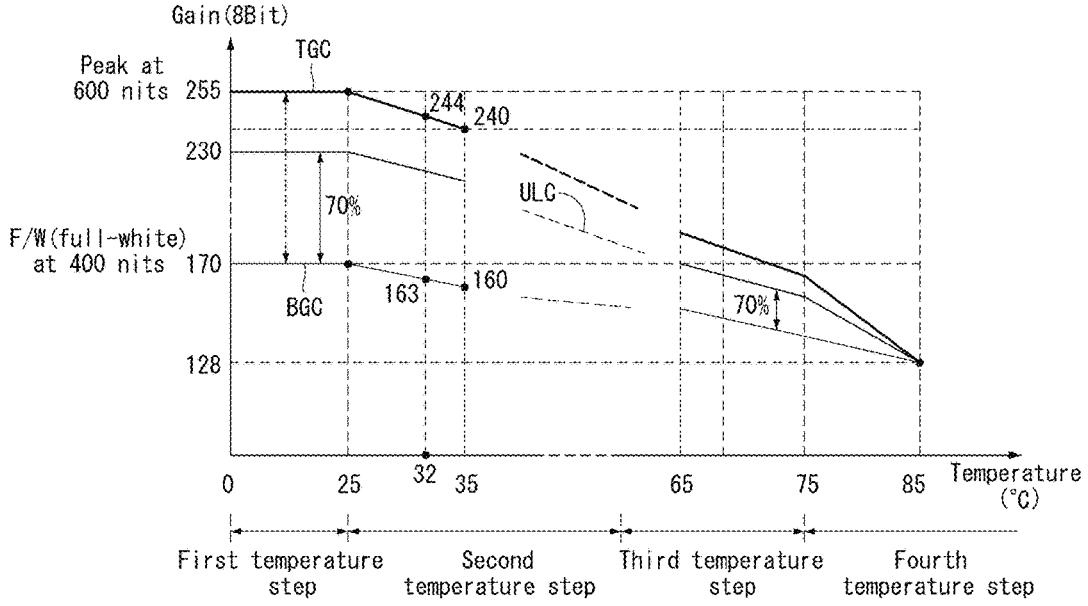
FIG. 8 is a view illustrating a temperature-dependent peak luminance output from a luminance control part according to an exemplary embodiment of the present invention.
Figures 9, 10:
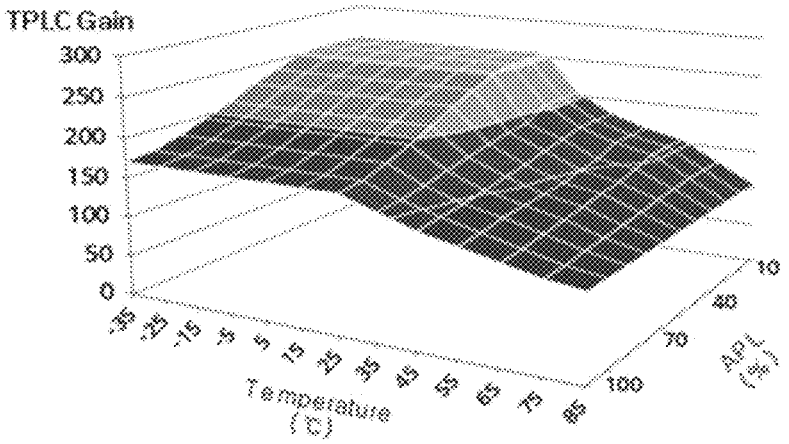
FIG. 9 is a view illustrating variation with APL of peak luminance gain.
FIG. 10 is a view illustrating relationship among temperature-dependent peak luminance, temperature and APL according to an exemplary embodiment of the present invention.

FIG. 8 is a view showing in detail temperature-dependent peak luminance output from a luminance control part according to an exemplary embodiment of the present invention. FIG. 9 is a view showing variation with APL of peak luminance gain.

Referring to FIG. 8, the luminance control part 133*c* calculates the peak luminance gain inversely proportional to the average picture level and the temperature-dependent peak luminance gain proportional to the difference between the peak luminance gain and the minimum luminance and inversely proportional to the difference between the maximum luminance and the minimum luminance, based on an average picture level APL input from the average picture level part 133*a* and a luminance range input from the temperature controller 133*b*, and calculates the temperature-dependent peak luminance proportional to the calculated temperature-dependent peak luminance gain and inversely proportional to the difference between the maximum luminance and the minimum luminance. The luminance control part 133*c* fixes the temperature-dependent peak luminance at a specific luminance level, regardless of changes in APL, at a specific temperature in a high-temperature range which is higher than a room-temperature range.

The luminance control part 133*c* may calculate the temperature-dependent luminance gain and the temperature-dependent peak luminance by the following [Equation 1] and [Equation 2]:

$$TPLC\ \text{Gain} = \frac{(PLC\ \text{Gain} - TBC\ \text{Gain Bottom})}{(TBC\ \text{Gain Top} - TBC\ \text{Gain Bottom})} \times 256 \quad \text{[Equation 1]}$$

$$TPLC\ \text{Out} = TBC\ \text{Gain Bottom} + (TBC\ \text{Gain Top} - TBC\ \text{Gain Bottom}) \times \frac{(TPCL\ \text{Gain} + 1)}{256} \quad \text{[Equation 2]}$$

where the PLC Gain is the peak luminance gain which is inversely proportional to the average luminance, the TBG Gain is the minimum luminance which decreases as the temperature of the display panel rises, and the TBC Gain Top is the maximum luminance which decreases as the temperature of the display panel 100 rises.

The above-described temperature-dependent peak luminance output from a luminance control device may be as shown on the curves of FIG. 8.

As illustrated in FIG. 8, the horizontal direction in the graph indicates temperature (° C.), and the vertical direction in the graph indicates gain (8 bits). In this case, the gain is 8 bits, but not limited to it. If the gain is 9 bits, the temperature-dependent peak luminance may be represented by a number ranging from 0 to 511. If the gain is 10 bits, the temperature-dependent peak luminance may be represented by a number ranging from 0 to 1023.

A temperature range over which the temperature increases progressively may be equally divided. The temperature range may be divided into first to fourth temperature steps. The first temperature step is a period of temperatures from 0 to 25° C., the second temperature step is a period of temperatures from 25 to 50° C., the third temperature step is a period of temperatures from 50 to 75° C., and the fourth temperature step is a period of temperatures from 75 to 100° C. Here, the first temperature step effectively refers to a room-temperature range since it ranges from 0 to 25° C., and the second temperature step effectively refers to a high-temperature range since it ranges from 75 to 100° C. Accordingly, the first temperature step may be used as a reference range, and the temperature-dependent peak luminance gain may be set based on the reference range.

It should be noted that, although FIG. 8 illustrates a temperature range of 0 to 100° C. for ease of explanation, the temperature is not limited to this range but may go below zero.

Referring to FIG. 9, the peak luminance gain decreases as the white area in a display image becomes wider. The peak luminance gain is 255 at 10% APL, the peak luminance gain is 230 at 20% APL, the peak luminance gain is 220 at 30% APL, the peak luminance gain is 215 at 40% APL, the peak luminance gain is 210 at 50% APL, the peak luminance gain is 200 at 60% APL, the peak luminance gain is 195 at 70% APL, the peak luminance gain is 184 at 80% APL, the peak luminance gain is 174 at 90% APL, and the peak luminance gain is 170 at 100% APL.

Referring to FIG. 8, a first curve is a maximum luminance curve, and the maximum luminance curve is a continuous curve showing how the maximum luminance decreases as the temperature of the display device rises, and a second curve is a minimum luminance curve, and the minimum luminance curve is a continuous curve showing how the minimum luminance decreases as the temperature of the display device rises. The maximum luminance curve may have a steeper decline with increasing temperature, compared to the minimum luminance curve. The third curve is a temperature-dependent peak luminance curve, and the temperature-dependent peak luminance may be calculated by the above [Equation 1] and [Equation 2], based on the peak luminance gain, maximum luminance curve, and minimum luminance curve.

In the first temperature step, the minimum luminance curve (TBC Gain Bottom) shows a minimum luminance of 170, and the maximum luminance curve (TBC Gain Top) shows a maximum luminance of 255. Here, the peak luminance gain is 230 at 20% APL. When these values are applied to [Equation 1], the temperature-dependent peak luminance gain for the first temperature step is calculated as follows:

$$\frac{(230 - 170)}{(255 - 170)} \times 256 = 180$$

Hence, the temperature-dependent peak luminance gain is 180.

Here, the first temperature step is a reference temperature range, which is a room-temperature range. Thus, the temperature-dependent peak luminance gain calculated for the first temperature step is used as a reference value for other temperature ranges. Accordingly, the temperature-dependent peak luminance gain also applies to the second to fourth temperature steps.

When the temperature-dependent peak luminance gain of 180 is applied to [Equation 2], the temperature-dependent peak luminance at 25° C. in the first temperature step is calculated as follows:

$$170 + (255 - 170) \times \frac{(180 + 1)}{256} = 230$$

Hence, the temperature-dependent peak luminance gain is 230.

At 32° C. in the second temperature step, the minimum luminance curve (TBC Gain Bottom) shows a minimum luminance of 163, the maximum luminance curve (TBC Gain Top) shows a maximum luminance of 244, and the temperature-dependent peak luminance gain is 180. When these values are applied to [Equation 2], the temperature-dependent peak luminance gain for 32° C. in the second temperature step is calculated as follows:

$$163 + (244 - 163) \times \frac{(180 + 1)}{256} = 220$$

Hence, the temperature-dependent peak luminance gain is 220.

At 35° C. in the second temperature step, the minimum luminance curve (TBC Gain Bottom) shows a minimum luminance of 160, the maximum luminance curve (TBC Gain Top) shows a maximum luminance of 240, and the temperature-dependent peak luminance gain is 180. When these values are applied to [Equation 2], the temperature-dependent peak luminance gain for 35° C. in the second temperature step is calculated as follows:

$$160 + (240 - 160) \times \frac{(180 + 1)}{256} = 216.5$$

Hence, the temperature-dependent peak luminance gain is 216.5.

At 85° C. in the fourth temperature step, the minimum luminance curve (TBC Gain Bottom) shows a minimum luminance of 128, the maximum luminance curve (TBC Gain Top) shows a maximum luminance of 180, and the temperature-dependent peak luminance gain is 180. When these values are applied to [Equation 2], the temperature-dependent peak luminance gain for 85° C. in the fourth temperature step is calculated as follows:

$$128 + (128 - 128) \times \frac{(180 + 1)}{256} = 128$$

Hence, the temperature-dependent peak luminance gain is 128.

As stated above, the maximum luminance and the temperature-dependent peak luminance converge to 128 at 85° C., within the high-temperature range.

The luminance control part 133*a* of this invention may adjust the luminance defined by the maximum luminance for a specific temperature in the high-temperature range to a specific luminance level. From the temperature-dependent peak luminance curve of FIG. 8, the maximum luminance for the room-temperature range is 255, and is adjusted to a specific luminance level of 128 at 85° C., within the high-temperature range. As such, the specific luminance level may be ½ the maximum luminance for the room-temperature range.

FIG. 10 is a view showing the relationship among temperature-dependent peak luminance, temperature, and APL according to an exemplary embodiment of the present invention.

FIG. 10 is a graph showing the relationship among temperature-dependent peak luminance, temperature, and APL. On the graph, the X-axis indicates temperature, the Y-axis indicates temperature-dependent peak luminance gain, and the Z-axis indicates APL.

The luminance control part adjusts such that the temperature-dependent peak luminance is fixed at a specific luminance level, regardless of changes in APL, at a specific temperature in a high-temperature range which is higher than a room-temperature range.

It can be seen that, at a specific temperature of 85° C. in the high-temperature range, the temperature-dependent peak luminance is fixed at a specific luminance level, even with a change in APL From 10% to 100%.

From the above-described details, those in the art will appreciate that various modifications are possible without departing from the technical spirit of the invention. Accordingly, the scope of the invention must not be limited to only details of the above-described embodiment, but defined by the claims.

What is claimed is:

1. A luminance control device comprising:

a temperature sensor that detects a temperature of a display device;

an average picture level part that calculates an average picture level, which defines an average brightness of an image input into the display device; and a luminance control part that generates a temperature-dependent peak luminance, which varies with temperature and average picture level, based on a top gain curve defining how a maximum luminance decreases as the temperature of the display device rises and a bottom gain curve defining how a minimum luminance decreases as the temperature of the display device rises, wherein the luminance control part fixes the temperature-dependent peak luminance at a specific luminance level, regardless of changes in average picture level, at a specific temperature in a high-temperature range which is higher than a room-temperature range, and wherein the luminance control part calculates a peak luminance gain inversely proportional to the average picture level, a temperature-dependent peak luminance gain proportional to a difference between the peak luminance gain and the minimum luminance and inversely proportional to a difference between the maximum luminance and the minimum luminance, based on the average picture level and the maximum and minimum luminance, and calculates the temperature-dependent peak luminance proportional to the calculated temperature-dependent peak luminance gain and inversely proportional to the difference between the maximum luminance and the minimum luminance.

2. The luminance control device of claim 1, wherein the luminance control part adjusts the luminance defined by the maximum luminance for a specific temperature in the high-temperature range to a specific luminance level.

3. The luminance control device of claim 1, wherein the specific luminance level is ½ the maximum luminance for the room-temperature range.

4. A display device comprising:

a data driver that converts an input image's pixel data to an analog gamma voltage to output and supply data voltages to data lines on a display panel;

a gate driver that supplies gate pulses synchronized with the data voltages to gate lines on the display panel; and a timing controller comprising a luminance control part that detects an ambient temperature of a display panel, that controls operation timings of the data driver and gate driver, that calculates an average picture level, which defines an average brightness of an image input into the display panel, and that generates a temperature-dependent peak luminance, which varies with temperature and average picture level, based on a top gain curve defining how a maximum luminance decreases as the temperature of the display panel rises and a bottom gain curve defining how a minimum luminance decreases as the temperature of the display panel rises, wherein the luminance control part fixes the temperature-dependent peak luminance at a specific luminance level, regardless of changes in average picture level, at a specific temperature in a high-temperature range which is higher than a room-temperature range; and wherein the luminance control part calculates a peak luminance gain inversely proportional to the average picture level, a temperature-dependent peak luminance gain proportional to a difference between the peak luminance gain and the minimum luminance and inversely proportional to a difference between the maximum luminance and the minimum luminance, based on the average picture level and the maximum and minimum luminance, and calculates the temperature-dependent peak luminance proportional to the calculated temperature-dependent peak luminance gain and inversely proportional to the difference between the maximum luminance and the minimum luminance.

5. The display device of claim 4, wherein the luminance control part adjusts the luminance defined by the maximum luminance for a specific temperature in the high-temperature range to a specific luminance level.

6. The display device of claim 4, wherein the specific luminance level is ½ the maximum luminance for the room-temperature range.

* * * * *